US009480885B1

(12) United States Patent
Tarwater

(10) Patent No.: US 9,480,885 B1
(45) Date of Patent: Nov. 1, 2016

(54) BALL RETRIEVER

(71) Applicant: Robert R. Tarwater, Texarkana, TX (US)

(72) Inventor: Robert R. Tarwater, Texarkana, TX (US)

( * ) Notice: Subject to any disclaimer, the term of this patent is extended or adjusted under 35 U.S.C. 154(b) by 38 days.

(21) Appl. No.: 14/226,585

(22) Filed: Mar. 26, 2014

Related U.S. Application Data

(60) Provisional application No. 61/805,352, filed on Mar. 26, 2013.

(51) Int. Cl.
*A63B 47/02* (2006.01)

(52) U.S. Cl.
CPC ..... *A63B 47/021* (2013.01)

(58) Field of Classification Search
CPC .. A63B 47/021; A63B 47/02; A63B 47/022; A63B 47/024
USPC ..... 414/434
See application file for complete search history.

(56) References Cited

U.S. PATENT DOCUMENTS 3,485,398 A * 12/1969 Maximilian ..... A63B 47/021 414/440
3,520,727 A * 7/1970 Crump ..... A63B 47/021 134/115 R
4,221,524 A * 9/1980 Morris ..... A63B 47/021 198/509
4,252,490 A * 2/1981 Keller ..... A63B 47/021 414/434
5,417,538 A * 5/1995 Wilde ..... A63B 47/024 414/434
5,527,075 A * 6/1996 Jones ..... A63B 47/021 294/19.2
6,079,930 A * 6/2000 Valdes-Rodriguez A63B 47/021 294/19.2
7,341,294 B2 * 3/2008 Olmstead ..... A63B 47/021 294/19.2
8,920,101 B2 * 12/2014 Leyco ..... A63B 47/021 294/19.2
2005/0204717 A1 * 9/2005 Colens ..... A63B 47/021 56/344
2007/0017948 A1 * 1/2007 Smithson ..... A45C 3/00 224/663

* cited by examiner

*Primary Examiner* — Kaitlin Joerger
(74) *Attorney, Agent, or Firm* — Polsinelli PC

(57) ABSTRACT

The ball retriever includes a collecting deck, a ramp, and a platform. The ball retriever is directed to balls for collection. The balls enter the collecting deck. A ramp is connected to the collecting deck. The collecting deck and the ramp pivot to transfer the balls to the platform. The platform may hold a hopper to contain the balls. The ball retriever provides an easy and fun way to pick up tennis balls, sports balls, and other objects.

21 Claims, 6 Drawing Sheets

BALL RETRIEVER

CROSS REFERENCE TO RELATED APPLICATION

This application claims the benefit of U.S. Provisional Patent Application 61/805,352 filed Mar. 26, 2013, which is hereby incorporated by reference.

FIELD OF INVENTION

The present invention relates to a ball retriever for collecting balls.

BACKGROUND

After a session of tennis practice, the tennis court is usually littered with tennis balls, and players and personnel must pick up the balls. The players or personnel must walk around to each ball, bend over, and pick up the ball. Further, it is difficult to hold more than three or four balls in each hand. Thus, the players or personnel must fill their hands, place the balls in a receptacle, and then pick-up more balls. Picking up balls is time consuming and laborious.

SUMMARY

The ball retriever includes a collecting deck, a ramp, and a storage area. The ball retriever is directed to balls for collection. The balls enter the collecting deck. The collecting deck pivots to transfer the balls to the storage area. The ball retriever provides an easy and fun way to pick up tennis balls, sports balls, and other objects.

The ball retriever is pushed by the user. The collecting deck scoops up the balls for collection. The user then pushes the handle in a downward direction to raise the collecting deck upward to dump the balls into a hopper positioned on the ball retriever. As the collecting 47603072.4 deck is raised upward, the balls roll down the ramp, via gravity, to the hopper on a rear platform of the ball retriever.

In one aspect, an apparatus to collect balls is described. The apparatus includes a collecting deck to collect the balls. A ramp connects to the collecting deck. The collecting deck and the ramp rotate to transfer the balls to a platform. A handle is used to cause the collecting deck and the ramp to rotate.

In another aspect, an apparatus to collect tennis balls is described. The apparatus includes a planar member positioned just above ground level. A transfer member is rigidly engaged to the planar member. A handle is moveable to contact a rear of the transfer member. A lower end of the handle presses against the rear of the transfer member. The planar member and the transfer member rotate together to dump the tennis balls from the planar member to a storage member.

In another aspect, an apparatus to collect objects is described. The apparatus includes a collecting deck and a ramp, which is rigidly engaged to the collecting deck. The collecting deck and the ramp are pivotally engaged to a frame. A platform is engaged to the frame. A handle includes a first side and a second side. The handle is pivotally engaged to the frame. The handle includes a lateral member connecting the first side of the handle and the second side of the handle. The pivoting of the handle upward urges the lateral member against a rear of the ramp to raise the ramp and the collecting deck. The frame includes the platform to hold a hopper.

In another aspect, a method of collecting objects is described. The method includes providing an apparatus to collect objects. The apparatus includes a collecting deck to collect objects, a ramp, and a platform. The collecting deck and the ramp rotate to transfer the objects to the platform. The method includes directing the apparatus to a plurality of objects. The method includes collecting the plurality of objects in the collecting deck. The method includes rotating the collecting deck and the ramp to transfer the objects to the platform.

DETAILED DESCRIPTION OF INVENTION

Figure 1:
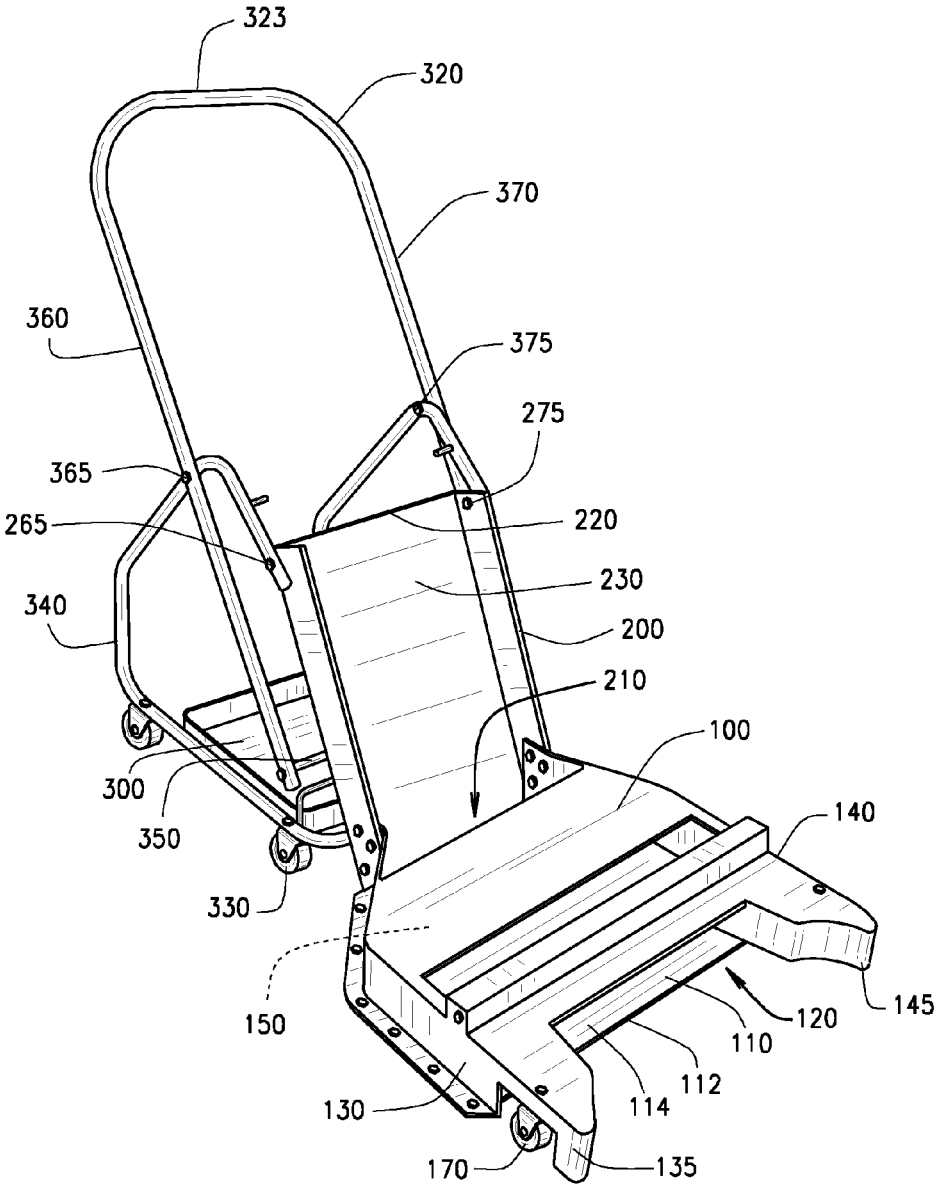
FIG. 1 is a perspective view of the ball retriever.
Figure 2:
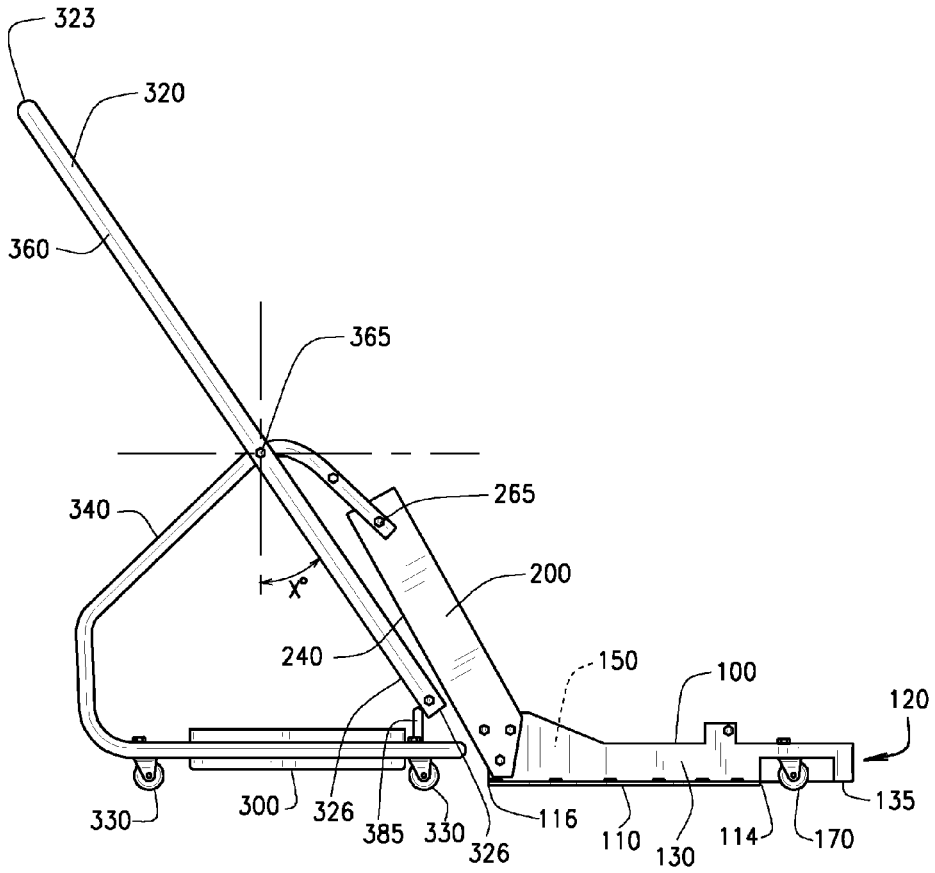
FIG. 2 is side view of the ball retriever.
Figure 3:
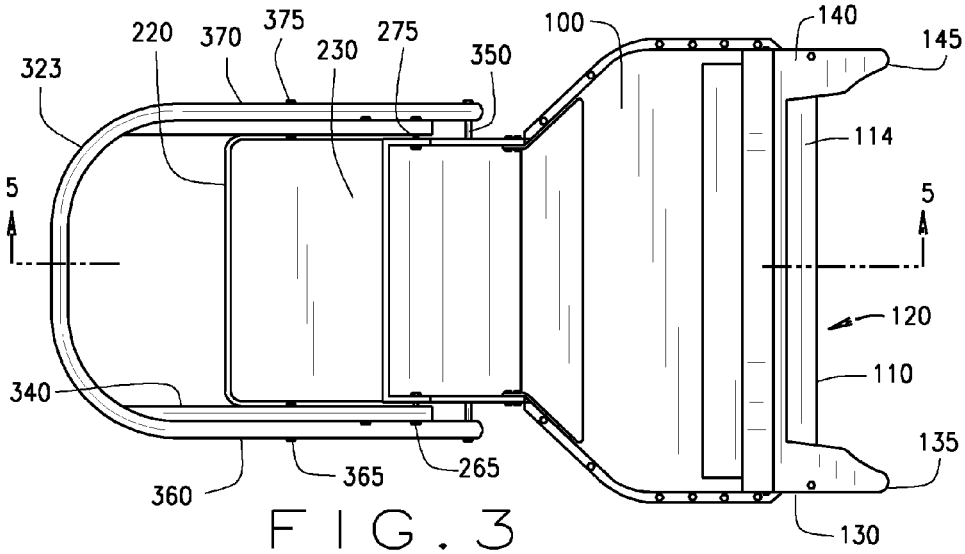
FIG. 3 is a top view of the ball retriever.
Figure 4:
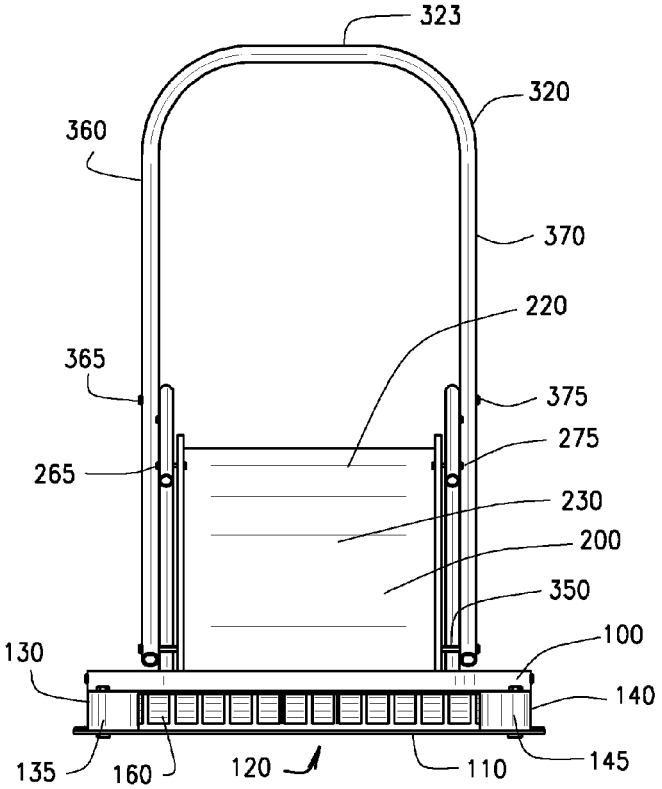
FIG. 4 is a front view of the ball retriever.
Figure 5:
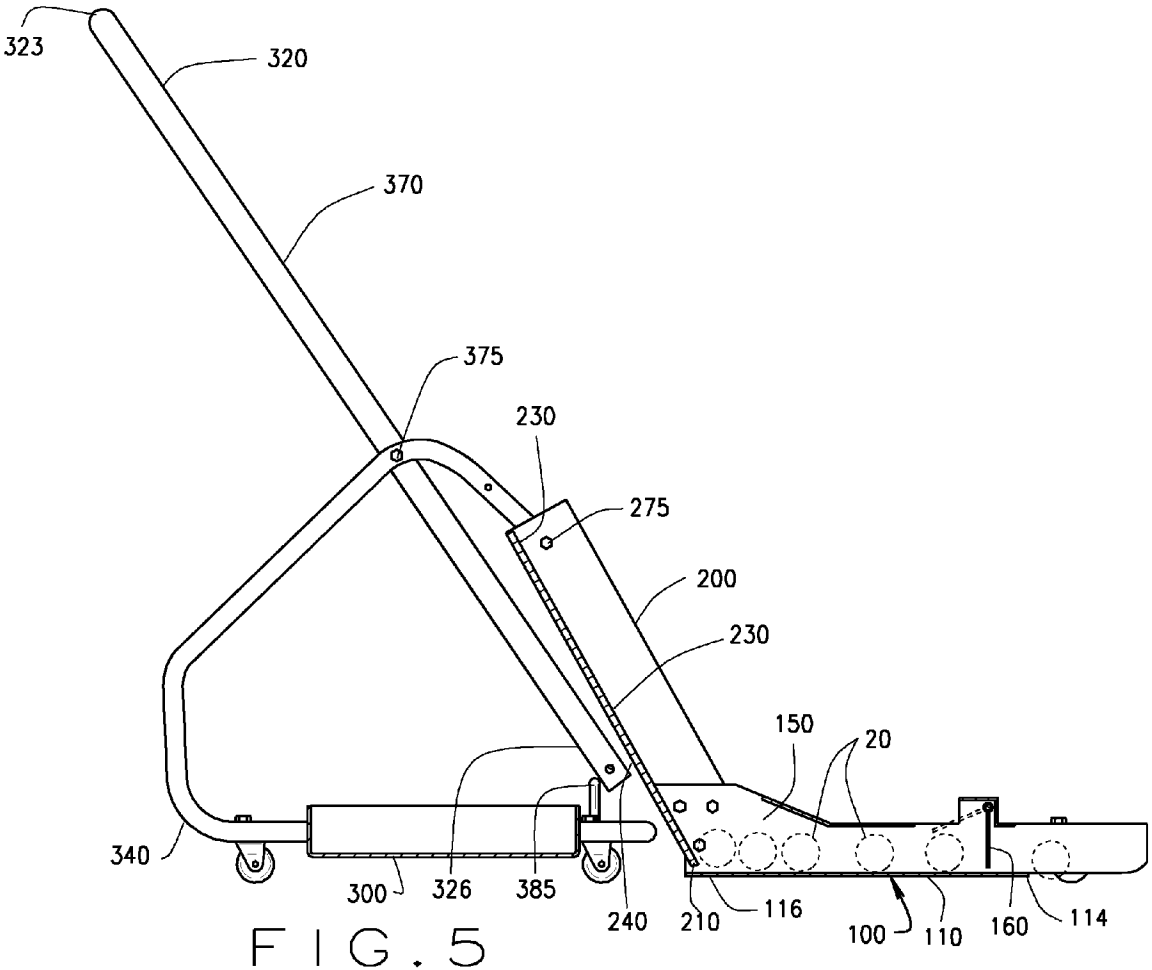
FIG. 5 is a side sectional view of the ball retriever.

A ball retriever 10 is described. The ball retriever 10 includes a collecting deck 100, a ramp 200, and a platform 300. The ball retriever 10 is directed to balls 20 for collection. The balls 20 enter the collecting deck 100. The collecting deck 100 pivots to transfer the balls 20 to the platform 300.

The balls 20 may include tennis balls, golf balls, baseballs, or other sporting balls. In addition to the balls 20, the ball retriever may 10 collect trash, debris, or other materials. The ball retriever 10 is well-suited for use in tennis facilities, batting cages, golf ranges and practice facilities, etc. where balls are dispersed. The ball retriever 10 may be used in an industrial setting to pick up washers, bolts, nuts, or other small items. The ball retriever 10 may be used in homes and day cares to pick up small toys, such as blocks, puzzle pieces, etc.

The ball retriever 10 positions the collecting deck 100 proximate ground level. The collecting deck 100 may include a funnel shape. The collecting deck 100 includes an opening 120 between a first side 130 and a second side 140. The opening 120 leads to a storage region 150. The opening 120 of the collecting deck 100 may be approximately 16 inches to approximately 24 inches wide. These measurements may be larger or smaller depending upon the application for the ball retriever 10.

The opening 120 of the collecting deck 100 includes a one-way style opening where balls 20 or other items collected by the deck 100 do not roll back out the opening 120. One or more fingers 160 are positioned in a generally vertical manner with respect to the opening 120. The one more fingers 160 rotate toward the ramp 200, i.e., toward a rear of the ball retriever 10. The one or more fingers 160 cannot rotate forward enough for the balls 20 to roll out the opening 120 of the collecting deck 100. Thus, once the balls 20 are in the storage region 150 of the collecting deck 100, the balls 20 are trapped until the balls 20 are dumped from the ramp 200.

The collecting deck 100 includes a generally planar member 110. A front 114 of the generally planar member 110 may include an angled lip 112. The generally planar member 110 is generally positioned horizontally to the ground during a collection mode of the ball retriever 10. The collecting deck 100 may include oppositely disposed directors 135 and 145 that funnel balls 20 or other items to the generally planar member 110. The collecting deck 100 may also include one or more wheels or casters 170. The generally planar member 110 is generally positioned just above the level of the ground or court. In the aspect of FIGS. 1-7, the generally planar member 110 is positioned approximately ⅛ to ¾ inches above the ground. This allows for a leading edge of the generally planar member to scoop or shovel under the balls 20, which directs them into the collecting deck 100. The front 114 of the generally planar member 110 may be slightly lower than a rear 116 of the generally planar member 110 in order to reduce hang-ups of the bottom of the collecting deck 100.

A lower surface of the collecting deck 100 includes the one or more wheels or casters 170. The casters 170 may be positioned on opposite sides of the collecting deck 100. The casters 170 may be positioned toward a front of the collecting deck 100. The casters 170 may be positioned behind the directors 135 and 145. The generally planar member 110 may be formed from plastic sheeting or fabric material positioned from the first side 130 of the collecting deck 100 to the second side 140 of the collecting deck 100.

From the collecting deck 100, the balls 20 pass to the ramp 200. When the collecting deck 100 is tilted, the balls 20 roll toward the ramp 200. The ramp 200 includes an opening 210 and an exit 220. The ramp 200 includes a ramp surface 230 positioned between the opening 210 and the exit 220. The ramp 200 may include a transfer member, such as a chute or other passage. In other aspects, the ramp 200 may include a cover or shield to help direct the balls 20 to a storage member 310 of the platform 300.

The collecting deck 100 and the ramp 200 are generally rigidly connected. As such, the collecting deck 100 and the ramp 200 rotate in unison. In some aspects, the collecting deck 100 and the ramp 200 may form an integral unit.

The ball retriever 10 includes a handle 320 and a frame 340. The handle 320 includes a lateral member 350 connecting a first side 360 of the handle 320 and a second side 370 of the handle 320. The lateral member 350 provides stability to the handle 320. However, in other aspects, the lateral member 350 may be replaced with studs, extensions, and the like, that that contact the rear surface 240 of the ramp 200, but do not extend fully from the first side 360 to the second side 370. The first side 360 of the handle 320 is pivotally engaged to the frame 340 at a first pivoting connection 365, and the second side 370 of the handle 320 is pivotally engaged to the frame 340 at a second pivoting connection 375. When the handle 320 is moved downward, the lateral member 350 presses against a rear surface 240 of the ramp 200 to force or urge the collecting deck 100 and the ramp 200 upwards in order to dump the balls 20. After moving upwards, the ramp 200 now angles toward to the platform 300, and the balls 20 roll out and fall to the platform 300. The handle 320 includes a first end 323 and a second end 326, and the second end 326 pivots to contact to the rear surface 240 of the ramp 200. The second end 326 may cause the ramp 200 to pivot. A user may grab the first end 323 to push the ball retriever 10 or to push the first end 323 downward to dump the balls 20. In other aspects, a lower portion of the handle 320 pivots to contact the rear surface 240 of the ramp 200 to raise the ramp 200. The handle 320 may include one or more generally straight members between the first end 323 and the second end 326. The frame 340 may include frame portions that rise or extend from the platform 300 in order to elevate the pivoting connections 365 and 375. The pivoting connections 365 and 375 are generally positioned between the first end 323 and the second end 326.

The ball retriever 10 includes the platform 300. The platform 300 is engaged to or supported by the frame 340. The platform 300 may include the storage member 310 such as a hopper, basket, bucket, bag or other receptacle to hold balls 20 or other items collected by the ball retriever 10. The storage member 310 may be integral or removable with the platform 300. For example, the ball retriever 10 may be provided with one or more hoppers for the storage member 310. As a first hopper is filled with balls 20 or other items, the first hopper may be removed and replaced by a second hopper.

A lower surface 320 of the platform 300 includes one or more wheels or casters 330. The platform 300 includes an upper surface 340 that may support the storage member 310. The storage member 310 is generally positioned to a rear of the ramp 200.

The ball retriever 10 is powered by the user. No motors or electrical power are required. The user pushes the ball retriever 10 in the direction of the balls 20 or other items to be collected. The balls 20 or other items roll or are urged up the ramp 200 to the collecting deck 100. When the collecting deck 100 is full of the balls 20, the user may tilt or lower the handle 320 to dump the balls 20 or other items from the collecting deck 100 into the storage member 310. The balls 20 or other items roll or fall from the collecting deck 100 to the storage member 310. For example, a ball 20 may roll or fall from the collecting deck 110 to the opening 210 of the ramp 200, roll or fall down the surface of the ramp 200, roll or fall from the exit 220 of the ramp 200, and into to the storage member 310.

The collecting deck 100 provides for the temporary storage of the balls 20 or other items. The collecting deck 100 will generally have a smaller volume for holding the balls 20 or other items than a volume of the storage member 310. In one aspect, the collecting deck 100 may hold approximately 25 to 35 tennis balls 20 prior to transfer to the storage member 310. The hopper positioned on the platform 300 may hold approximately 85 to 100 tennis balls 20.

Figure 6:
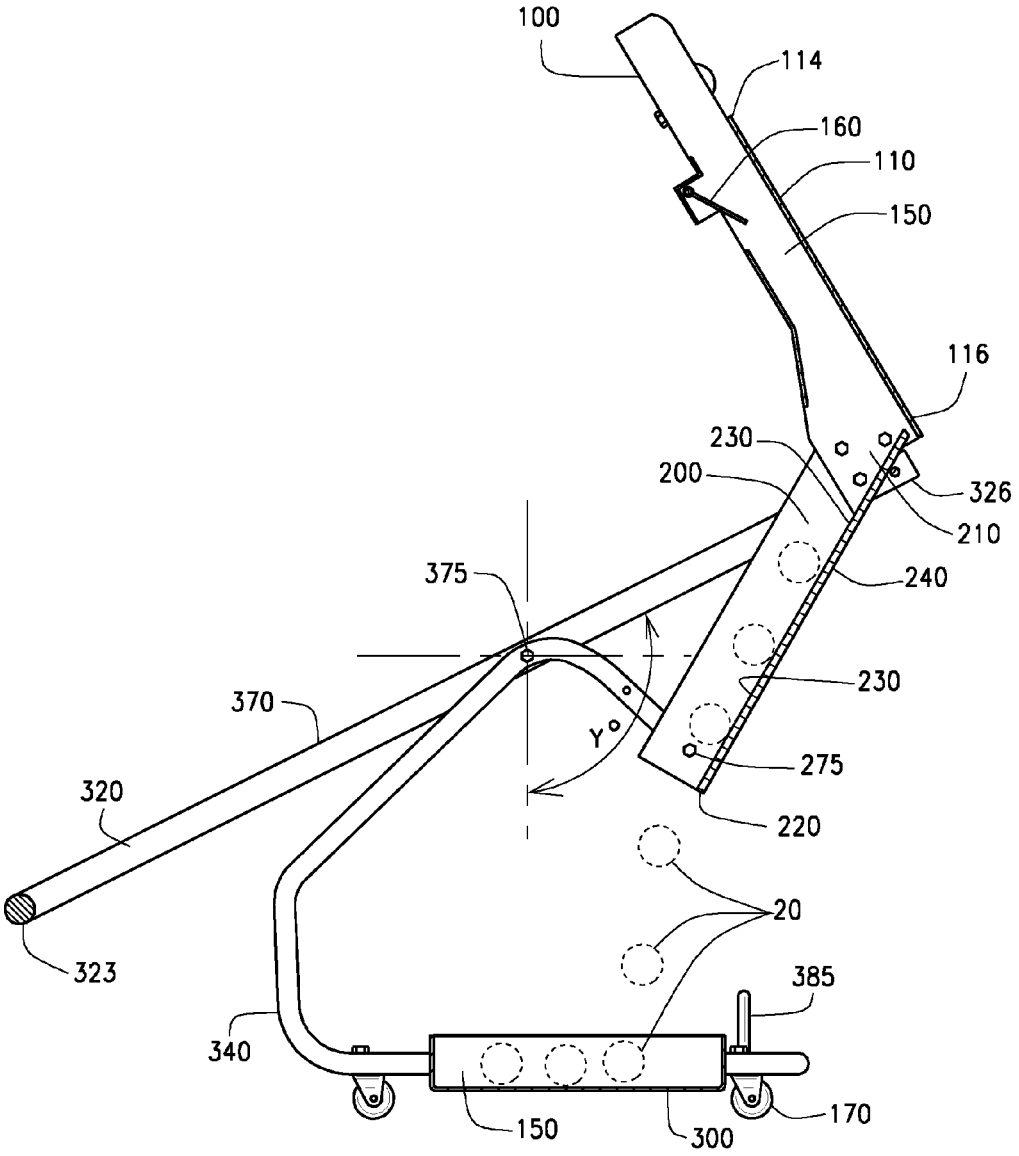
FIG. 6 is a side sectional view of the ball retriever showing the transfer of the balls to the platform.
Figure 7:
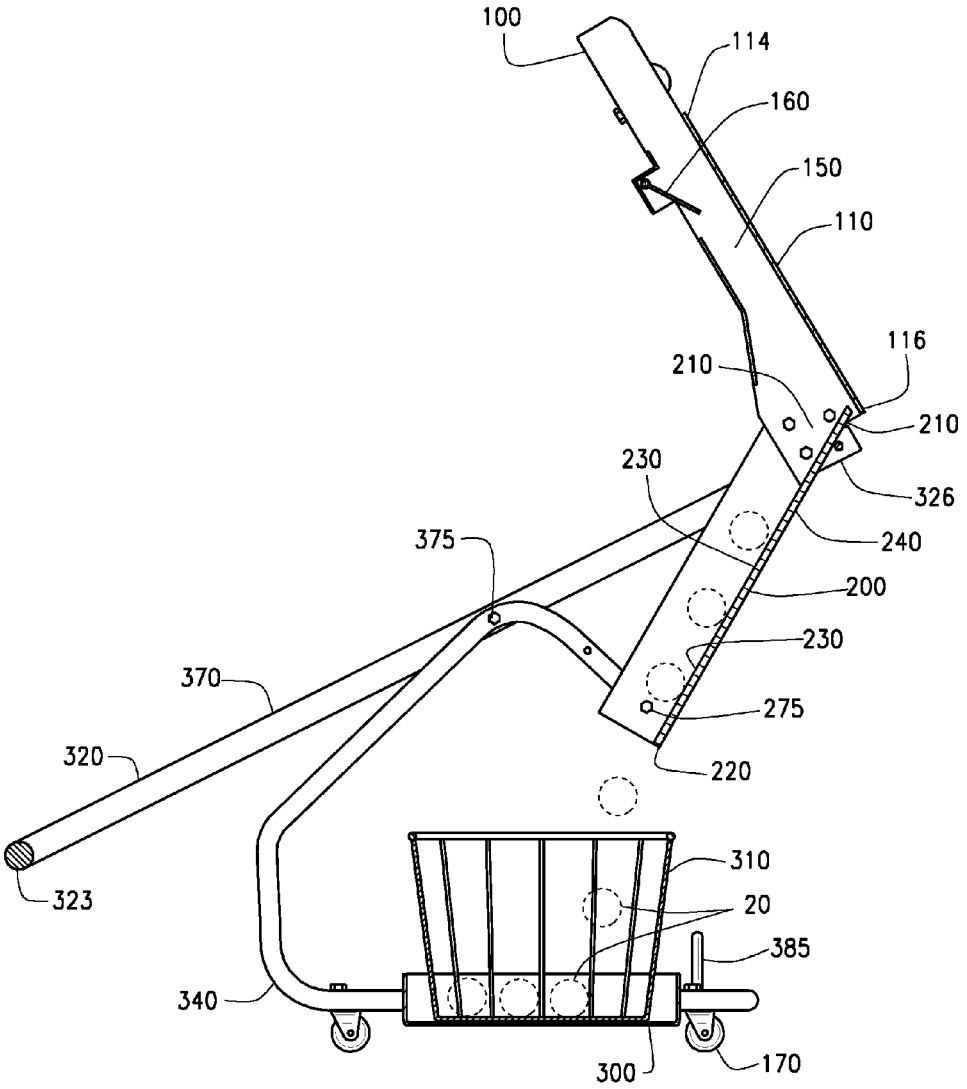
FIG. 7 is a side sectional view of the ball retriever dumping the balls into the hopper.

The handle 320 pivotally engages to the ball retriever 10. The user pushes down on the handle 320 in order to tilt the collecting deck 100 and the ramp 200. With reference to FIG. 6, the handle 320 is pivotally engaged to the frame 340 of the ball retriever 10. The ramp 200 is also pivotally engaged with respect to the frame 340. The ramp 200 is engaged to the frame 340 at pivotal connections 265 and 275. The pivotal connections 265 and 275 are generally positioned between the pivoting connections 365 and 375 and the second end 326 of the handle 320. The frame 340 may include frame portions that rise or extend from the platform 300 in order to elevate the pivotal connections 265 and 275. The pivotal connections 265 and 275 are also generally positioned forward of the pivoting connections 365 and 375, i.e., closer to the opening 120. The second end 326 of the handle 320 contacts the rear surface 240 of the ramp 200 below the pivoting connections 265 and 275 in order to raise the ramp 200. The ramp 200 is rigidly engaged to the collecting deck 100. The pivoting of the first end 323 of the handle 320 downward, i.e., in a counter-clockwise direction in FIG. 2, urges the lateral member 350 upward against the rear surface 240 of the ramp 200 to raise the ramp 200 and the collecting deck 100 in order to transfer the balls 20 or other items to the storage member 310.

In the collection mode, the ramp 200 is angled at approximately 25 degrees to approximately 45 degrees to the vertical plane. This is shown as angle X in FIG. 2. In the transfer mode, the ramp 200 rotates or pivots upward approximately 60 degrees to approximately 120 degrees to provide for the gravity transfer of the balls 20 or other items into the storage member 310. This is shown as angle Y in FIG. 6. The ramp 200 needs to rotate or pivot enough for the balls 20 to roll from the collection deck 100 to the storage member 310.

A top surface of the platform 300 includes one or more stops 385, which stop the clockwise rotation of the handle 320. When the handle 320 is pushed, the stops 385 prevent the handle 320 from rotating too far forward. The stops 385 may include a mechanical member, such as stud or bar, extending vertically from the platform 300 to contact the handle 320.

The frame 340 and the handle 320 may be made from tubular metal alloys or other rigid materials such as thermoplastic.

As described above, the ball retriever 10 is not limited by the types of objects picked up. The methods and apparatus herein may collect trash, debris, or other materials. The methods and apparatus herein may be used in an industrial setting to pick up washers, bolts, nuts, or other small items. The methods and apparatus herein may be used in homes and day cares to pick up small toys, such as blocks, puzzle pieces, etc.

What is claimed is:

1. An apparatus to collect balls, comprising:
a collecting deck to collect balls;
a ramp;
a frame;
a handle;
a platform, the platform engaged to the frame;
the handle pivots to rotate the collecting deck and the ramp relative to the frame to transfer the balls to the platform; and,
the collecting deck includes a storage region, and the ramp directs the balls from the storage region to a storage member of the platform.

2. The apparatus according to claim 1, wherein the collecting deck includes an opening, and one or more fingers are positioned along the opening in a generally vertical manner with respect to the opening, and the one or more fingers pivot towards a rear of the apparatus.

3. The apparatus according to claim 1, wherein the collecting deck includes an opening in open communication with the storage region of the collecting deck, and the opening includes one more rotating fingers, wherein the rotating fingers rotate toward a rear of the apparatus to collect the balls, wherein the fingers are configured to not rotate toward a front of the apparatus to prevent the balls from passing from the storage region to the opening and out of the collecting deck.

4. The apparatus according to claim 1, wherein the collecting deck and the ramp both pivot upward.

5. The apparatus according to claim 1, wherein the ramp is rigidly fixed to the collecting deck and at an angle of approximately 25 degrees to approximately 45 degrees with respect to a vertical plane.

6. The apparatus according to claim 1, wherein the collecting deck includes a generally planar member positioned just above ground level.

7. The apparatus according to claim 1, wherein the collecting deck includes one or more wheels or casters, and the platform includes one or more wheels or casters.

8. The apparatus according to claim 1, wherein the handle is pivotally engaged to the frame, the handle includes a first end and a second end, and wherein the second end pivots to contact to a rear of the ramp.

9. An apparatus to collect balls, comprising:
a collecting deck to collect balls;
a ramp;
a platform;
the collecting deck and the ramp rotate to transfer the balls to the platform; and;
a frame and a handle, wherein the handle is pivotally engaged to the frame, and the handle includes a first end and a second end, and wherein the second end pivots to contact to a rear surface of the ramp.

10. The apparatus according to claim 9, wherein the handle comprises a lateral member connecting a first side of the handle and a second side of the handle, and the first side of the handle is pivotally engaged to the frame at a first pivoting connection, and the second side of the handle is pivotally engaged to the frame at a second pivoting connection.

11. The apparatus according to claim 9, wherein the handle comprises a lateral member connecting a first side of the handle and a second side of the handle, and the first side of the handle is pivotally engaged to the frame at a first pivoting connection between the first end and the second end, and the second side of the handle is pivotally engaged to the frame at a second pivoting connection between the first end and the second end.

12. The apparatus according to claim 1, wherein the handle is pivotally engaged to the frame, and the ramp is pivotally engaged to the frame.

13. The apparatus according to claim 1, wherein the handle includes a lateral member connecting a first side of the handle and a second side of the handle, the first side of the handle is pivotally engaged to the frame at a first pivoting connection, the second side of the handle is pivotally engaged to the frame at a second pivoting connection, a first side of the ramp is pivotally engaged to the frame at a third pivoting connection, and a second side of the ramp is pivotally engaged to the frame at a fourth pivoting connection.

14. An apparatus to collect tennis balls, comprising:
a planar member positioned just above ground level;
a transfer member rigidly engaged to the planar member;
a frame member; the frame member holding the planar member and the transfer member in a pivotal engagement;
a storage member;
a handle moveable to contact a rear of the transfer member; and,
the planar member and the transfer member rotate together, relative the frame member, to dump tennis balls from the planar member to the storage member.

15. An apparatus to collect objects, comprising:
a collecting deck;
a ramp, the ramp rigidly engaged to the collecting deck;
a frame, the collecting deck and the ramp pivotally engaged to the frame;
a platform, the platform engaged to the frame; and,
a handle comprising a first side and a second side, the handle pivotally engaged to the frame, the handle comprising a lateral member connecting the first side of the handle and the second side of the handle, wherein the pivoting of the handle upward urges the lateral member against a rear of the ramp to raise the ramp and the collecting deck.

16. A method of collecting objects, comprising:
providing an apparatus to collect objects, comprising:

a collecting deck to collect objects;

a ramp;

a platform;

the collecting deck and the ramp rotate to transfer the objects to the platform; and, the handle includes a first end and a second end, and wherein the second end pivots to contact to a rear surface of the ramp;

directing the apparatus to a plurality of objects;

collecting the plurality of objects in the collecting deck;

rotating the handle and pushing on the rear surface of the ramp with the second end of the handle and causing the ramp and the collection deck to rotate; and, rotating the collecting deck and the ramp to transfer the objects to the platform.

17. The method according to claim 16, wherein the objects are tennis balls.

18. The method according to claim 16, further comprising placing a receptacle on the platform and transferring at least several tennis balls to the first receptacle.

19. The method according to claim 16, further comprising placing a first receptacle on the platform; transferring at least several tennis balls to the first receptacle; removing the first receptacle from the platform; placing a second receptacle on the platform; and, transferring additional tennis balls to the second receptacle.

20. An apparatus to collect tennis balls, comprising:

a frame;

a collecting deck to collect tennis balls, the collecting deck pivotally engaged to the frame;

the collecting deck includes an opening, and one or more fingers are positioned along the opening in a generally vertical manner with respect to the opening, and the one or more fingers pivot towards a rear of the apparatus;

a handle, the handle pivotally engaged to the frame;

a storage area on the frame; and, the handle pivots relative to the frame to cause the collecting deck to rotate relative to the frame to transfer the tennis balls to the storage area.

21. The apparatus according to claim 1, wherein the collecting deck includes an opening, and one or more fingers are positioned along the opening in a generally vertical manner with respect to the opening, and the one or more fingers pivot towards a rear of the apparatus to provide a one-way style opening to prevent the balls from rolling back out the opening.

* * * * *